US005704477A

United States Patent [19]

Hermann et al.

[11] Patent Number: 5,704,477

[45] Date of Patent: Jan. 6, 1998

[54] PALLET-TYPE STORAGE/TRANSPORT CONTAINER.

[75] Inventors: Francis Hermann, Mittelbronn; Philippe Roser, Volksberg; Claude Decroix, Saverne, all of France

[73] Assignee: Sotralentz S.A., Drulingen, France

[21] Appl. No.: 566,828

[22] Filed: Dec. 4, 1995

[30] Foreign Application Priority Data

| | | | |
|---|---|---|---|
| Dec. 7, 1994 | [DE] | Germany | 44 43 447.2 |
| Jan. 26, 1995 | [DE] | Germany | 195 02 364.1 |
| May 29, 1995 | [DE] | Germany | 195 18 997.3 |
| Jul. 11, 1995 | [DE] | Germany | 195 25 152.0 |

[51] Int. Cl.[6] ..... B65D 19/00

[52] U.S. Cl. ..... 206/386; 220/401; 206/599

[58] Field of Search ..... 206/386, 595, 206/597, 599, 598, 596; 220/401; 108/51.1

[56] References Cited

U.S. PATENT DOCUMENTS

| | | | |
|---|---|---|---|
| 4,795,057 | 1/1989 | Jungels et al. | 220/401 |
| 5,060,815 | 10/1991 | Wendling et al. | 220/401 |
| 5,358,137 | 10/1994 | Shuert et al. | 220/401 |
| 5,501,334 | 3/1996 | Przytulla et al. | 220/401 |

*Primary Examiner*—Paul T. Sewell
*Assistant Examiner*—Nhan T. Lam
*Attorney, Agent, or Firm*—Herbert Dubno; Andrew Wilford

[57] ABSTRACT

A storage/transport container has a rigid and floor-forming pallet having a generally rectangular outer edge having four sides, an annular and erect outer wall in the form of a gridwork of metal rods defining a plurality of generally flat side panels extending upward from the sides of the edges, meeting at corners, and each formed of a set of horizontal metal rods and a set of vertical metal rods, and an inner vessel composed of flexible plastic material enclosed by the outer wall and supported on the pallet. The gridworks are attached to the pallet generally at the respective sides thereof. The rods of one of the sets of each side panel are each formed with at least two straight outer portions lying generally in a respective vertical plane extending upwardly from the respective side and joining the respective corners and at least two straight angled portions extending at an acute angle to the respective vertical plane and each having an outer end connected at the respective plane to one of the respective outer portions and an inner end connected inward of the respective plane to one of the inner ends of one of the angled portions of the respective rod. Thus the straight and angled portions together form at least one inset on each side panel.

20 Claims, 9 Drawing Sheets

PALLET-TYPE STORAGE/TRANSPORT CONTAINER

FIELD OF THE INVENTION

The present invention relates to a pallet-type storage/transport container. More particularly this invention concerns such a container used for the shipment and storage of fluent materials, such as liquids or bulk particles.

BACKGROUND OF THE INVENTION

In commonly owned U.S. patent application (atty's 19822) filed 6 Nov. 1995 a container is described having an annular and erect outer wall in the form of a gridwork of metal rods having a lower edge and provided at the edge with an annular metal stiffening rod. A wooden floor-forming pallet downwardly closes the wall, forms with the wall an outer vessel, and has a ground-engaging lower surface, an opposite and horizontal upper surface, and a pair of vertical and generally parallel and longitudinally extending side edges. A metallic brace bar transversely bridges the pallet between its side edges, lies on the upper surface of the pallet, forms at each side edge a down-wardly open notch engaging downwardly over the stiffening rod and has at each edge a downwardly extending tab formed outside the respective seat with a horizontally throughgoing hole. Respective metallic clips engage through the holes and under the lower stiffening rod and screws engaged vertically through the brace bar and clips into the pallet secure same together. An inner vessel composed of flexible plastic material is enclosed by the outer wall and supported on the floor.

Thus with this system any tendency of the floor region to spread, which is a particular problem with four-way pallets that are not transversely interconnected, is largely countered by the transverse brace bar. Thus spreading of the sides of the container is unlikely, even if it is handled roughly. The lower wall-reinforcing stiffening rod is captured in the ends of the brace bar so that it cannot deform in this region, and in fact the brace bar also transversely reinforces the wooden pallet. The stiffening rod is very effectively held and the parts holding it are mainly stressed in shear or tension as the inner vessel is filled, so that considerable force can be withstood.

The problem with this construction is that the sides can still bulge out above the braced floor region, in particular since, when such a container is about 1 meter on a side, it can hold about 1 ton of liquid. Thus even though the bottom of the container maintains its shape perfectly, the sides can bulge out and the containers cannot be packed tightly against each other.

OBJECTS OF THE INVENTION

It is therefore an object of the present invention to provide an improved shipping/storage container for fluent materials.

Another object is the provision of such an improved shipping/storage container for fluent materials which overcomes the above-given disadvantages, that is which does not exceed certain dimensions even when filled.

SUMMARY OF THE INVENTION

The instant invention is an improvement on a storage/transport container having a rigid and floor-forming pallet having a generally rectangular outer edge having four sides, an annular and erect outer wall in the form of a gridwork of metal rods defining a plurality of generally flat side panels extending upward from the sides of the edges, meeting at corners, and each formed of a set of horizontal metal rods and a set of vertical metal rods, and an inner vessel composed of flexible plastic material enclosed by the outer wall and supported on the pallet. The gridworks are attached to the pallet generally at the respective sides thereof. According to the invention the rods of one of the sets of each side panel are each formed with at least two straight outer portions lying generally in a respective vertical plane extending upwardly from the respective side and joining the respective corners and at least two straight angled portions extending at an acute angle to the respective vertical plane and each having an outer end connected at the respective plane to one of the respective outer portions and an inner end connected inward of the respective plane to one of the inner ends of another one of the angled portions of the respective rod. Thus the angled portions together form at least one inset on each side panel.

With this system the insets greatly stiffen the side panels of the container so that any outward bulging of the side panels when the liner is filled will be largely eliminated, or at worst will be confined to lie within the envelope defined by the side planes. The rods are spaced closely enough, relative to the stiffness of the material of the liner vessel that same does not bulge out past the side planes. Thus the containers according to this invention lie wholly within the footprint of their bases and can be stacked directly against one another without worrying about damaging or piercing the liner vessel. The arrangement using gridworks formed according to the invention is much stronger than the standard prior-art system whose walls are formed of sheet metal that is punched out to lighten it and stamped with ribs to stiffen it. Similarly the profiled gridwork according to the invention is so much stronger than the prior art planar grid-works that greater strength can be achieved with fewer rods.

According to the invention the one sets are the horizontal sets and the outer portions of each side meet and are joined at the corners with the outer portions of an adjacent side. Alternately the one sets are the vertical sets. In either embodiment the rods of the one set of rods further can have at least one straight inner portion lying inward of the respective vertical plane, extending parallel thereto, and connected between two of the respective inner portions. Each horizontal rod has in each side panel one such inner portion flanked by two such angled portions in turn flanked by two such outer portions. This forms a single wide inset. In another arrangement the inner ends are directly connected together to form a V-section inset. In this case for stiffening purposes a respective rod of the other set is fixed to the rods of the one set where the inner ends are connected together.

In the storage/transport container according to the invention the rods of the one set of each side are each formed with more than two such outer portions and more than two such angled portions forming at least two groove-like reinforcing insets in the respective side panel.

The liner vessel in accordance with the invention can have flat and smooth side walls. It can also have side walls into which are molded with grooves complementary to and interfitting with the insets.

According to the invention the pallet is made principally of wood and is provided with clips securing itself to a lowermost one of the horizontal rods of each side panel. It can also be made of sheet steel and include a generally rectangular upper plate defining the edge, an annular base frame shaped to fit within an upper end of the wall of another such container, and spacer blocks fixed between the frame and the plate and projecting outward past the frame to the edge. Thus when one such container is stacked atop another such container the blocks rest atop and the frame fits within the topmost horizontal rod of the wall of the underlying container.

The frame of the sheet-steel pallet can be tubular or made of profiled steel elements, for example flat or L-section steel strips. Either way, the frame is dimensioned to lie within the insets when the containers are fitted together. Such an arrangement is extremely strong and allows the containers to be stacked several high without squashing the bottom container.

The rods according to the invention are all of round section, are welded together, and include an uppermost horizontal rod that is stronger than the other horizontal rods. The horizontal rods are all annular and continuous and the corners are rounded.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 6A is a larger-scale view of the detail indicated at arrow VIA of FIG. 6;

FIG. 6B is a view like FIG. 6A indicating a variant on the invention;

SPECIFIC DESCRIPTION

Figure 1:
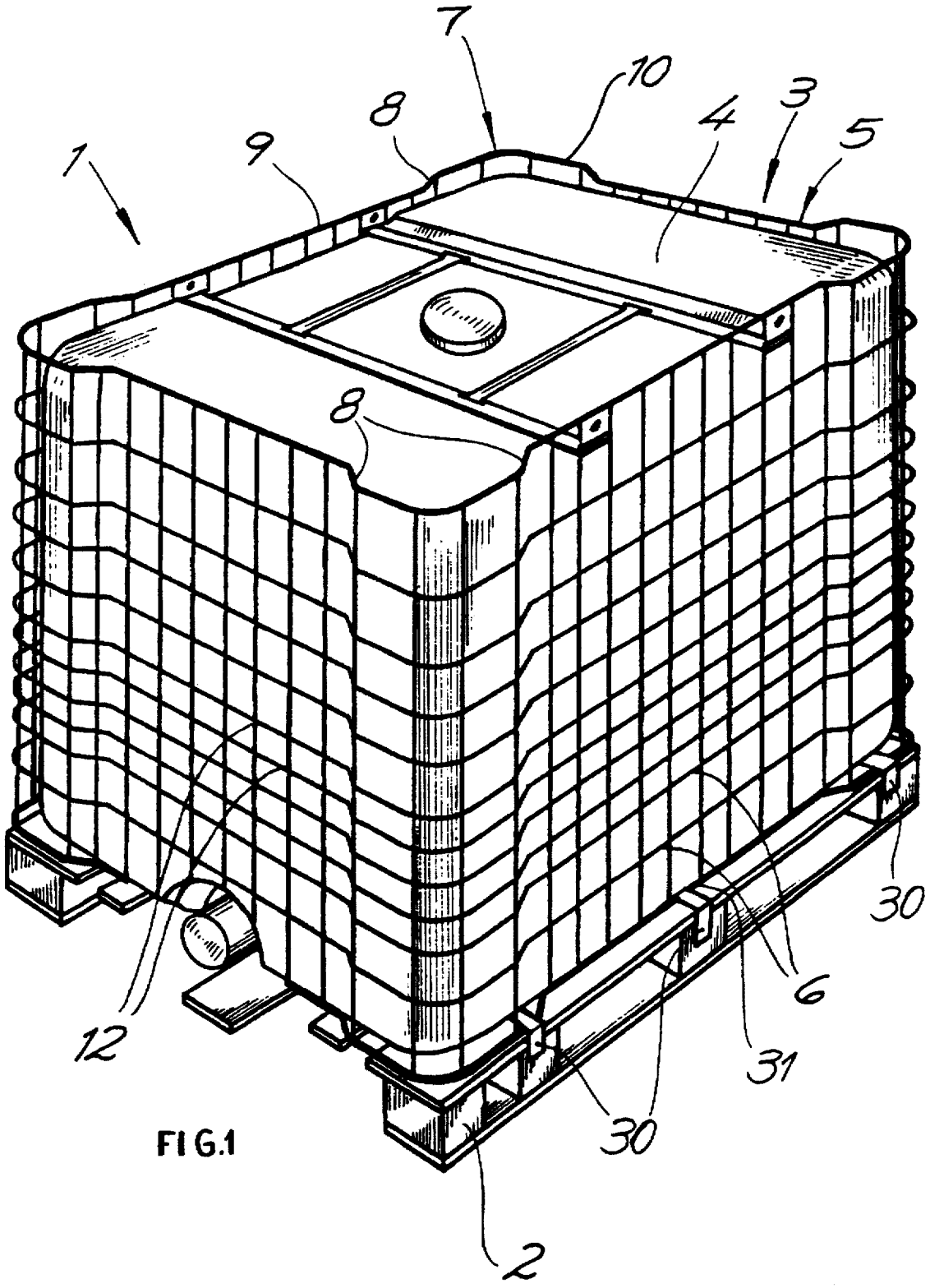
FIG. 1 is a small-scale perspective view of a first embodiment of the storage/transport container according to the invention.
Figure 2:
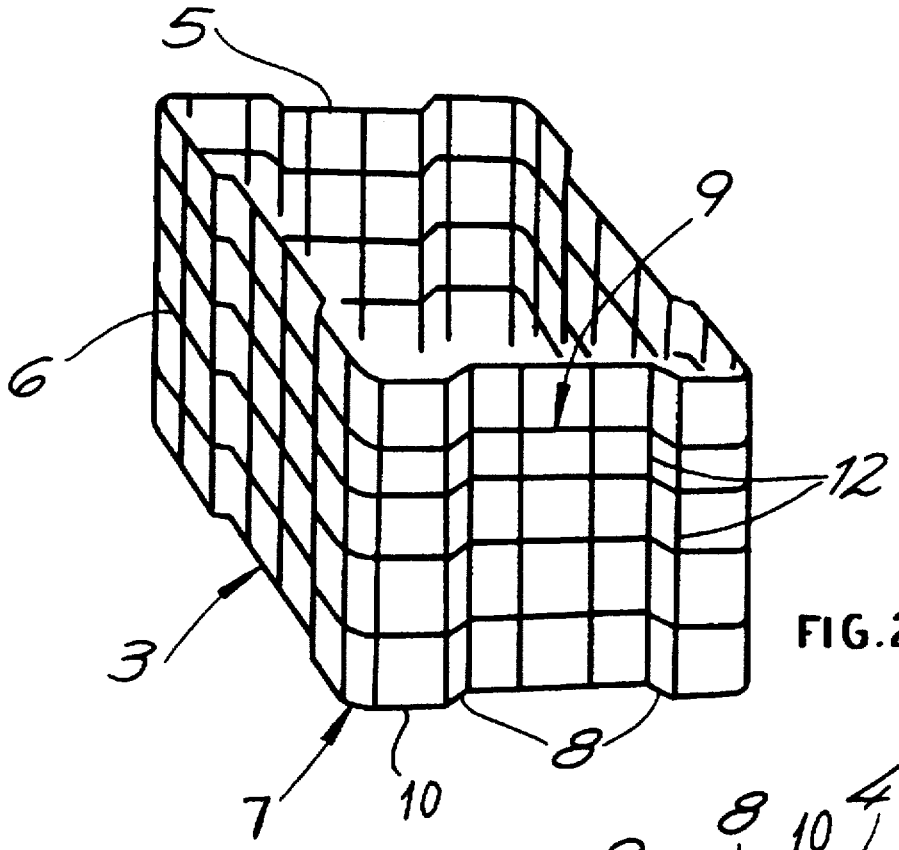
FIG. 2 is a simplified and small-scale perspective view of the gridwork wall of the container of FIG. 1.

As seen in FIGS. 1 through 3A a container 1 according to the invention has a rigid and rectangular pallet base 2 here formed of wood, an annular gridwork side wall 3 formed of horizontal rods 6 and vertical rods 12, and a liner vessel or bladder 4. This container 1 is intended to hold something fluent, normally a liquid, for shipping and/or storage. The uppermost horizontal rod 5 of the wall 3 is normally substantially stronger than the remaining horizontal rods 6 and the container 1 has rounded corners 7.

Figure 3A:
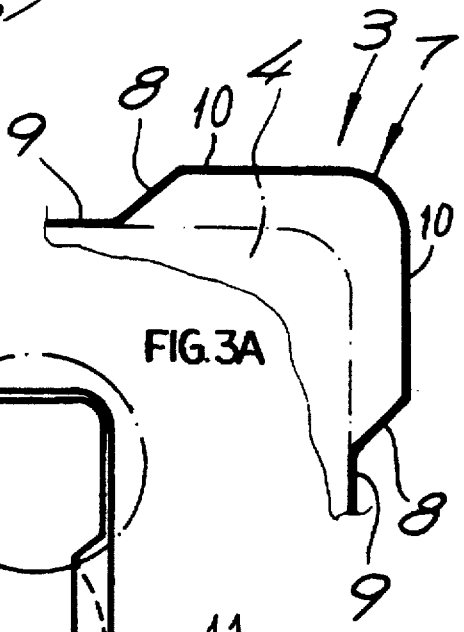
FIG. 3A is a larger-scale view of the detail indicated at IIIA in FIG. 3.
Figure 3:
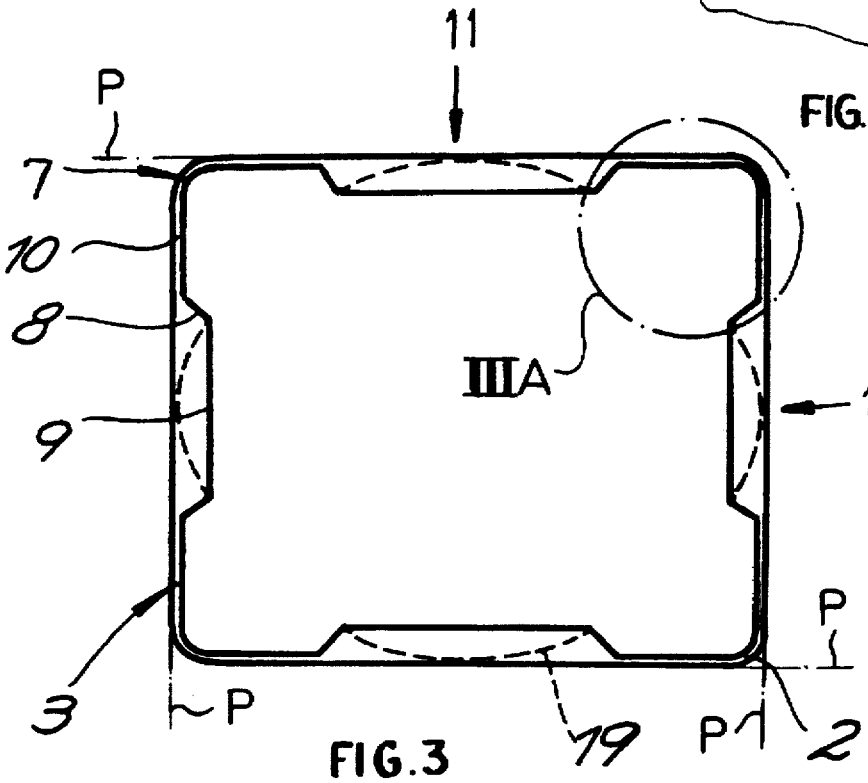
FIG. 3 is a small-scale simplified top view of the wall of FIG. 2.

According to the invention the vertical rods 12 are straight but the horizontal rods 6 are bent, having straight and inset inner portions 9 that lie as seen in FIG. 3 inward of planes P defined by the four straight side edges of the pallet 2, straight outer portions 10 lying generally on these planes P and meeting at corners 7, and 45°-angled straight connecting portions 8 some 3 cm–5 cm long and each having an outer end at one of the respective outer portions 10 and an inner end at one of the respective inner portions 9. The result is a large inset 11 in the center of each side of the wall 3.

Figure 4:
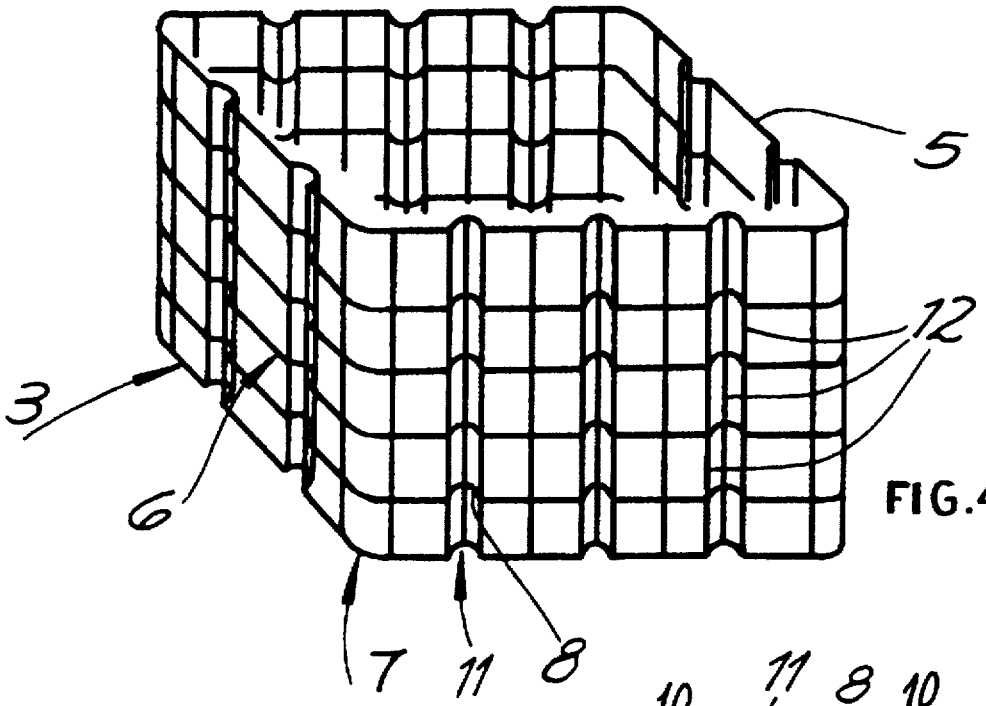
FIG. 4 is a view like FIG. 2 of a second embodiment of the invention.
Figure 5A:
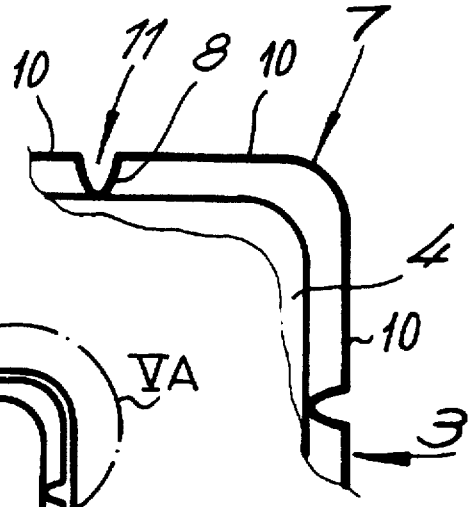
FIG. 5A is a larger-scale view of the detail indicated at VA in FIG. 5.
Figure 5:
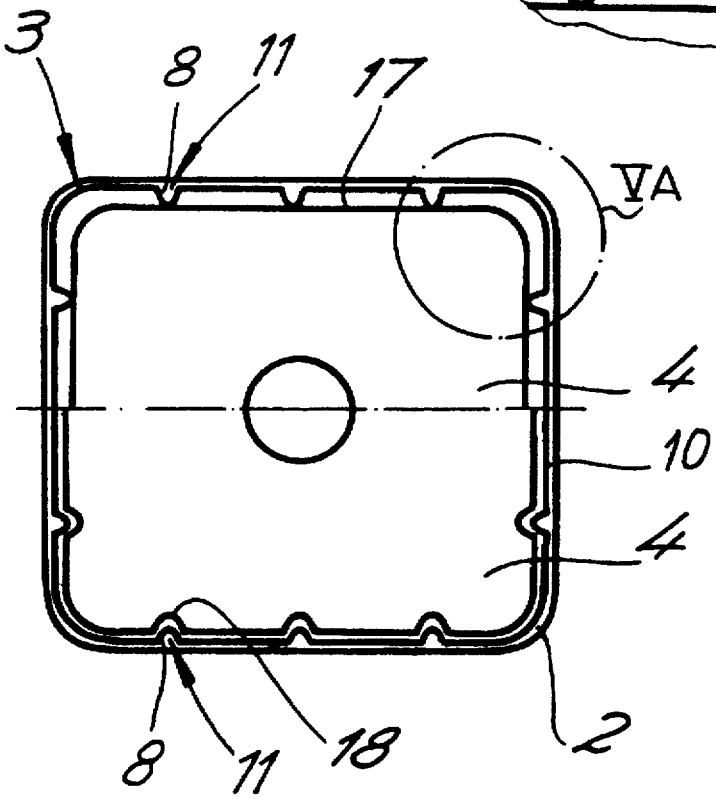
FIG. 5 is a view like FIG. 3 of the wall of FIG. 4.

In the arrangement of FIGS. 4, 5, and 5A instead of one long inset per side, the wall 3 has three very short insets 11 in that there are no inner portions 9, and one of the vertical rods 12 runs (see FIG. 4) along the innermost portion of each inset 11.

Figure 6:
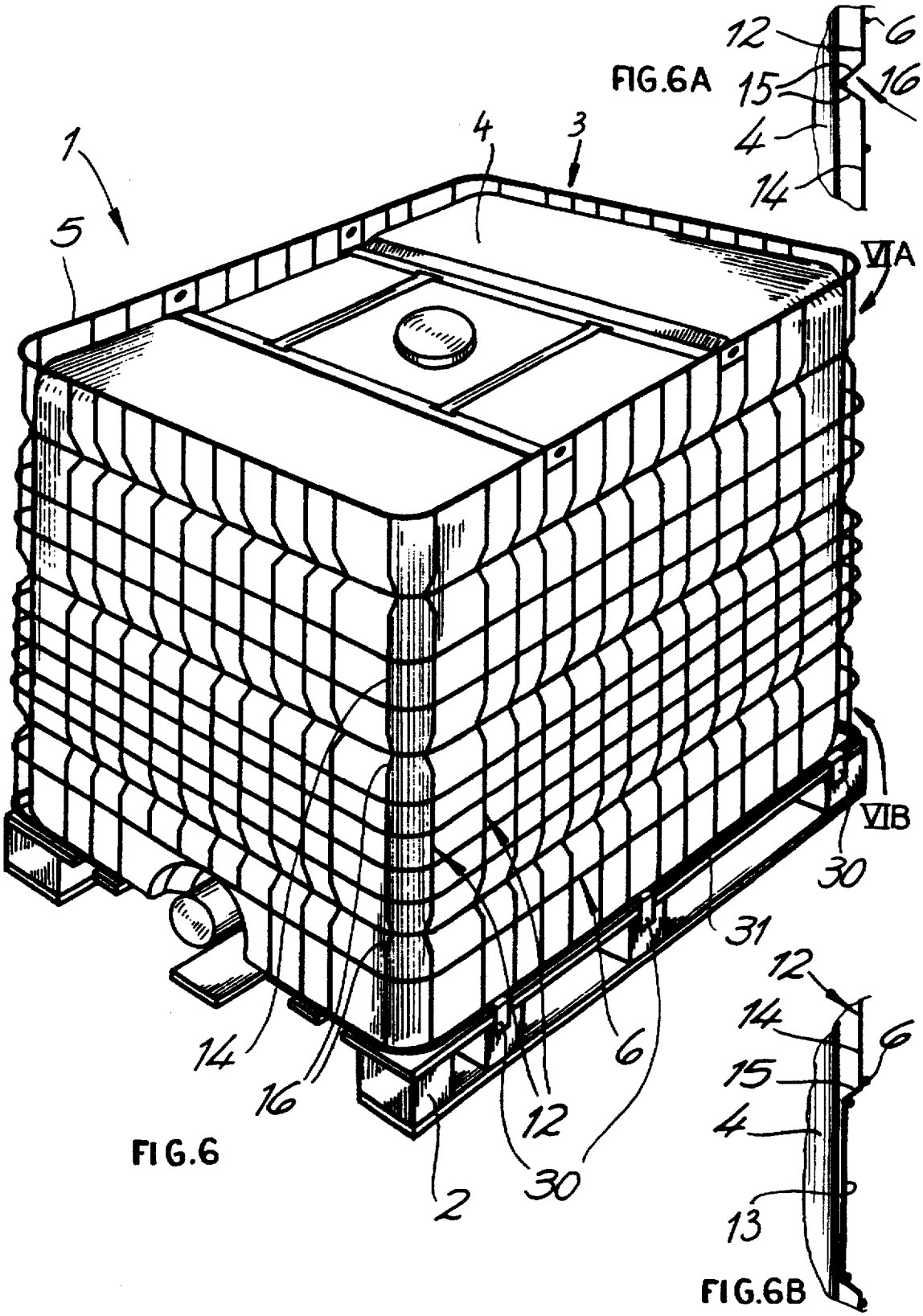
FIG. 6 is a perspective view of a third embodiment of the container according to the invention.
Figure 7:
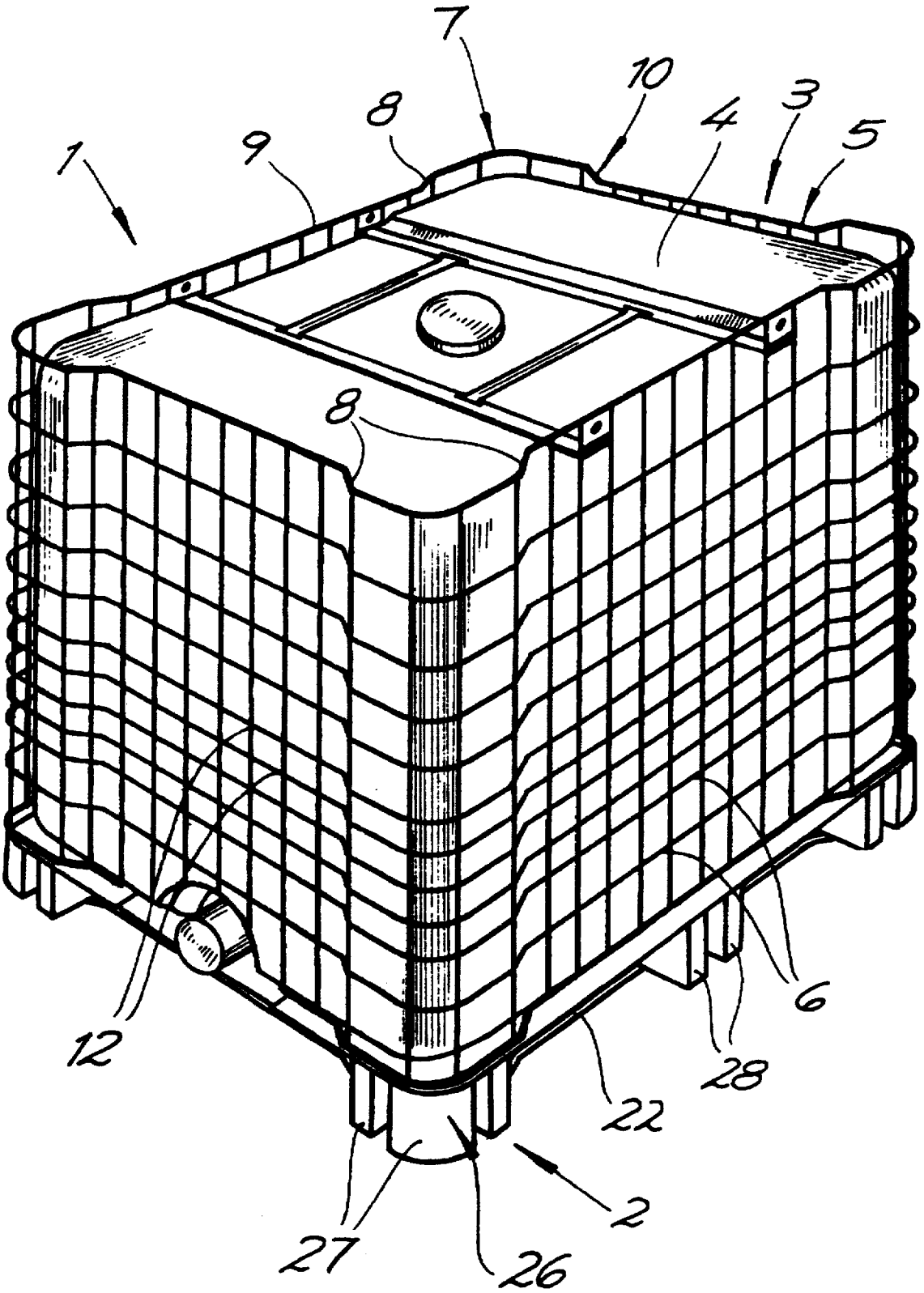
FIG. 7 is a perspective view of a fourth embodiment of the container of this invention.
Figure 8:
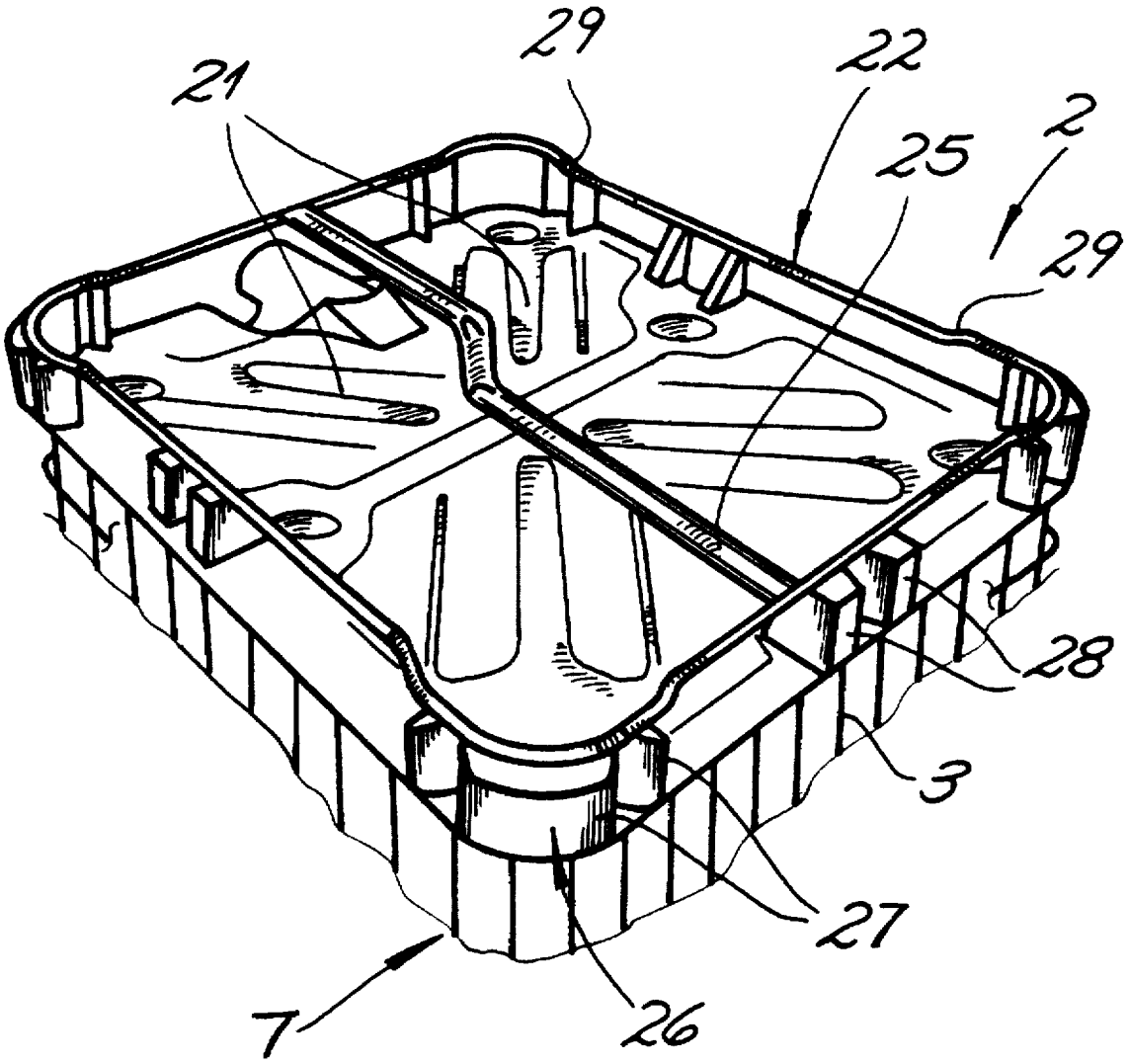
FIG. 8 is a bottom-view of the pallet part of the container of FIG. 7.
Figure 9:
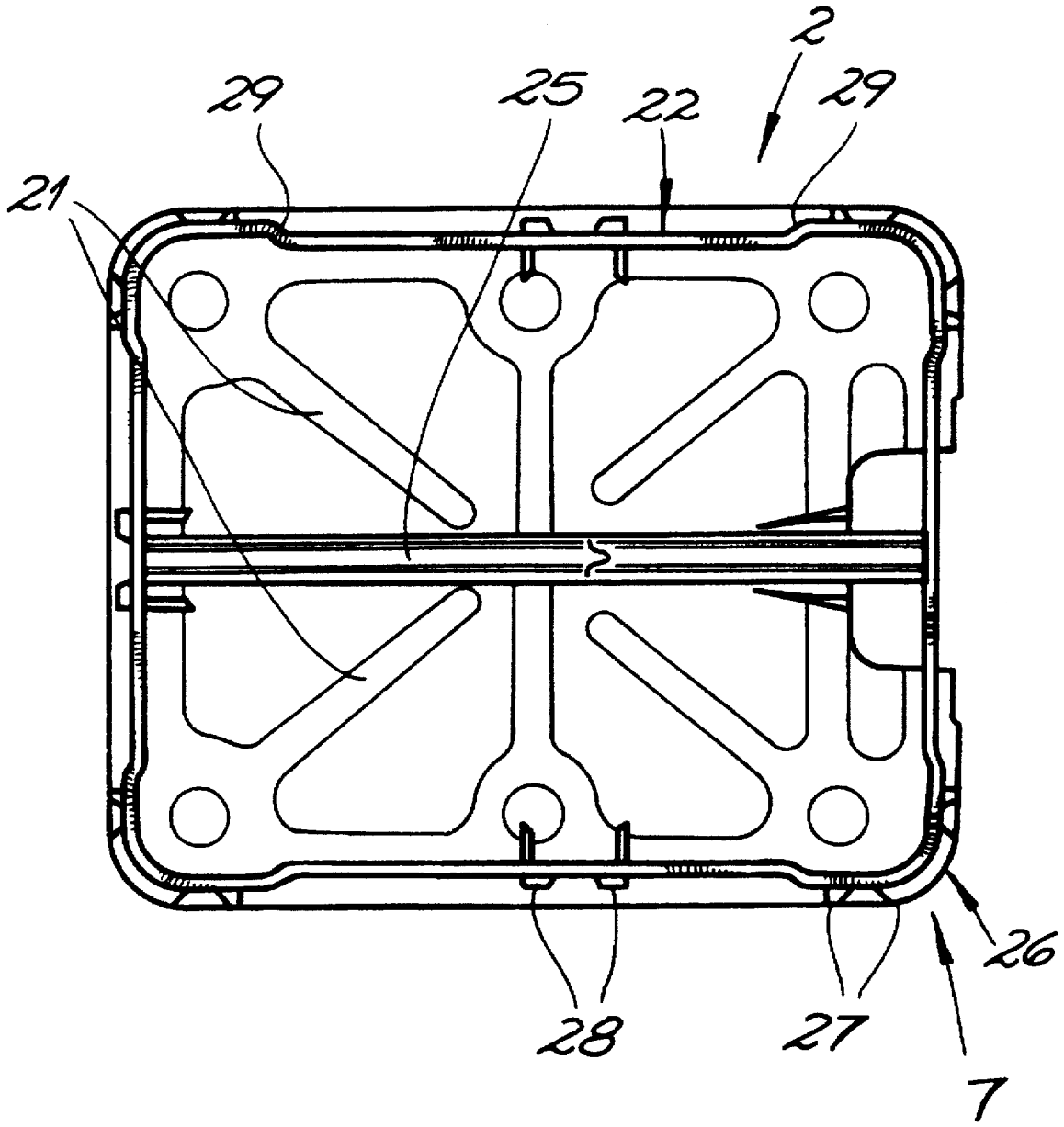
FIG. 9 is a top view of the pallet of FIG. 8.

FIGS. 6 and 6A show another arrangement wherein the horizontal rods 6 run straight between the corners 7, but the vertical rods 12 are bent, having straight outer portions 14 lying generally on these planes P and 45°-angled straight connecting portions 15 each having an outer end at one of the respective outer portions 14 and an inner end connected to another of the outer portions 14. This forms relatively narrow horizontal insets 16. FIG. 6B shows how inner portions 13 can be provided connecting the inner ends of the angled portions 15 to form a wide inset 16.

FIG. 3 shows at 19 how the bladder or liner can belly out without going beyond the footprint of the pallet 2. In FIG. 5 the bladder 4 has on one side a flat wall 17 and on the other side a wall formed with grooves 18 that fit with the vertical insets 11.

The pallet 2 in FIGS. 1 through 6 is wooden and has clips 30 secured to a lowermost horizontal rod 31.

Figure 10:
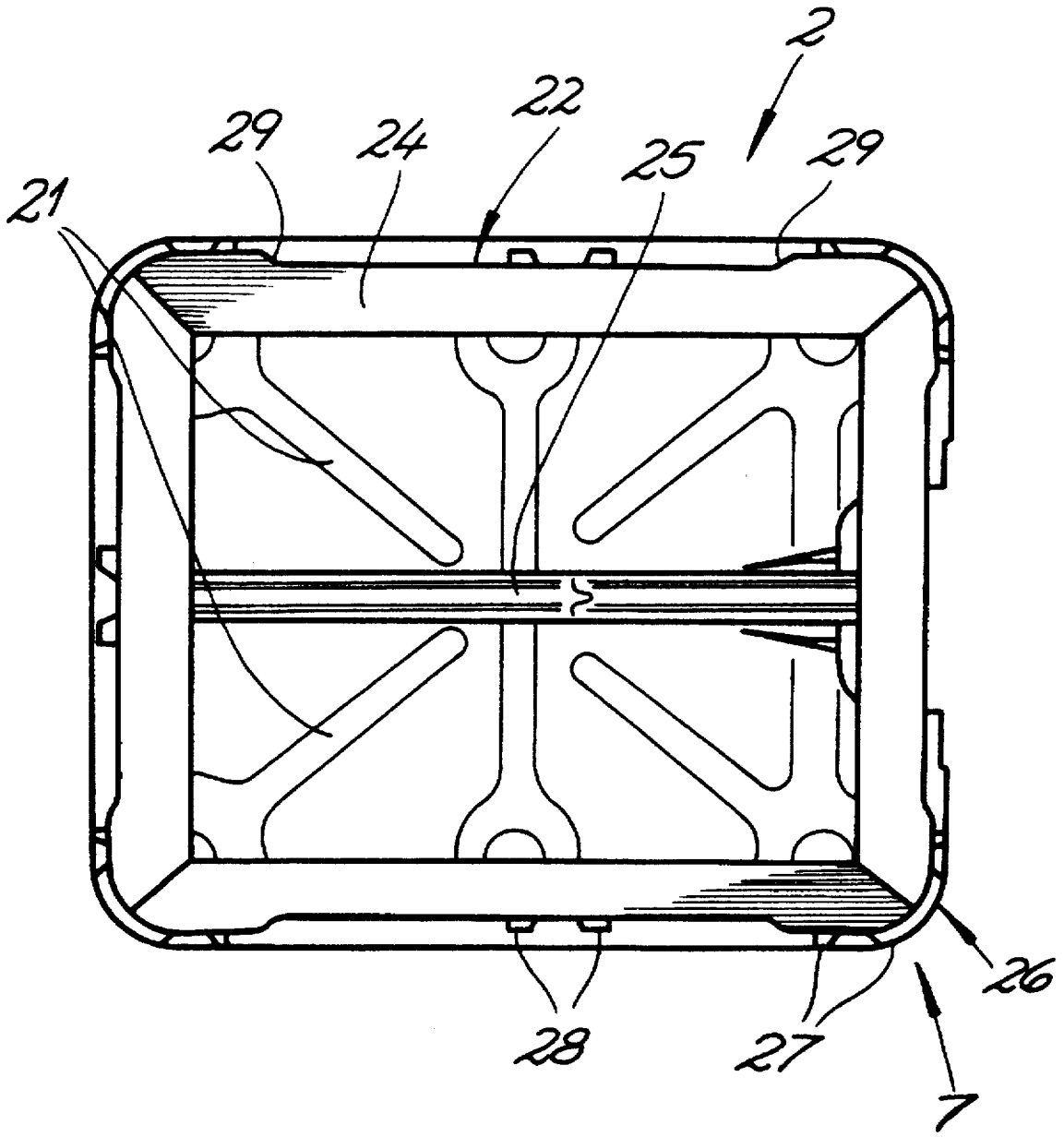
FIG. 10 is a view like FIG. 9 of another pallet according to the invention.
Figure 11:
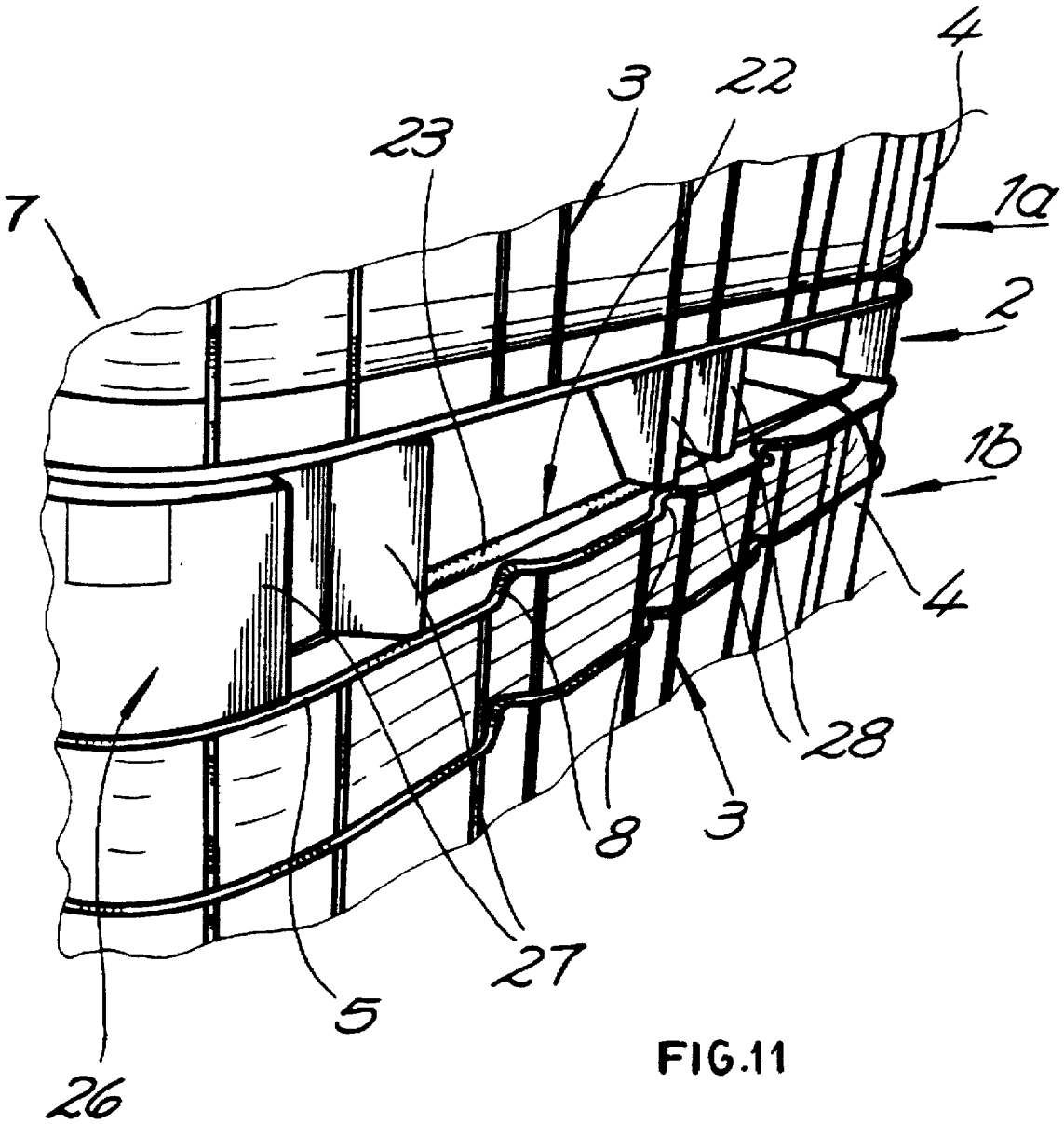
FIG. 11 is a large-scale perspective view of a detail of two containers as in FIG. 7 stacked atop each other.

FIGS. 7 through 11 show how the pallet 2 can be made of sheet steel. It has an upper plate 20 formed with stiffening ribs 21 and with a periphery that defines the planes P shown in FIG. 3. On its bottom as shown in FIGS. 7–9 and 11 it has sheet-metal corner pieces 26 flanked by support blocks 27 and in the middle of each side are further metal support blocks 28. The corners 26 and blocks 27 and 28 are all interconnected to and overlain by an annular frame 22 formed by a piece of tubing. In FIG. 10 the piece of tubing is replaced by an annular profiled metal plate 24. The blocks 27 and 28 extend transversely of the respective edges so that as shown in FIG. 11 when a container 1a is stacked atop a container 1*b* the blocks 27 and 28 of the over-lying container 1*a* as well as its corners 26 will lie on the extra-strong upper horizontal rod 5 of the wall 3. A stiffening strut 25 extends across the frame 22 between the centers of opposite sides thereof.

In addition the frame 22 is formed with indents 29 that match the indents 11 of the wall 3, but the overall dimensions are slightly smaller so that when the containers are stacked the frame 22 of the top container 1*b* will lie just inside the rod 5 of the underlying container 1*b*. In this manner the two containers 1*a* and 1*b* interfit and will not be able to slide horizontally relative to each other, while at the same time the tines of a lift truck can easily enter between the blocks 27 and 28.

We claim:

1. In a storage/transport container having:

a rigid and floor-forming pallet having a generally rectangular outer edge having four sides;

an annular and erect outer wall in the form of a grid-work of metal rods defining a plurality of generally flat side panels extending upward from the sides of the edges, meeting at corners, and each formed of a set of horizontal metal rods and a set of vertical metal rods, the gridworks being attached to the pallet generally at the respective sides thereof; and an inner vessel composed of flexible plastic material enclosed by the outer wall and supported on the pallet, the improvement wherein the rods of one of the sets of each side panel are each formed with at least two straight outer portions lying generally in a respective vertical plane extending upwardly from the respective side and joining the respective corners, and at least two straight angled portions extending at an acute angle to the respective vertical plane and each having an outer end connected at the respective plane to one of the respective outer portions and an inner end connected inward of the respective plane to one of the inner ends of one of the angled portions of the respective rod, whereby the straight and angled portions together form at least one inset on each side panel.

2. In a storage/transport container having:

a rigid and floor-forming pallet having a generally rectangular outer edge having four sides;

an annular and erect outer wall in the form of a grid-work of metal rods defining a plurality of generally flat side panels extending upward from the sides of the edges, meeting at corners, and each formed of a set of horizontal metal rods and a set of vertical metal rods, the gridworks being attached to the pallet generally at the respective sides thereof; and an inner vessel composed of flexible plastic material enclosed by the outer wall and supported on the pallet, the improvement wherein the horizontal rods of each side panel are each formed with at least two straight outer portions lying generally in a respective vertical plane extending upwardly from the respective side and joining the respective corners, and at least two straight angled portions extending at an acute angle to the respective vertical plane and each having an outer end connected at the respective plane to one of the respective outer portions and an inner end connected inward of the respective plane to one of the inner ends of one of the angled portions of the respective rod, whereby the straight and angled portions together form at least one inset on each side panel.

3. The storage/transport container defined in claim 2 wherein the outer portions of each side meet and are joined at the corners with the outer portions of an adjacent side.

4. In a storage/transport container having:

a rigid and floor-forming pallet having a generally rectangular outer edge having four sides;

an annular and erect outer wall in the form of a grid-work of metal rods defining a plurality of generally flat side panels extending upward from the sides of the edges, meeting at corners, and each formed of a set of horizontal metal rods and a set of vertical metal rods, the gridworks being attached to the pallet generally at the respective sides thereof; and an inner vessel composed of flexible plastic material enclosed by the outer wall and supported on the pallet, the improvement wherein the vertical rods each side panel are each formed with at least two straight outer portions lying generally in a respective vertical plane extending upwardly from the respective side and joining the respective corners, and at least two straight angled portions extending at an acute angle to the respective vertical plane and each having an outer end connected at the respective plane to one of the respective outer portions and an inner end connected inward of the respective plane to one of the inner ends of one of the angled portions of the respective rod, whereby the straight and angled portions together form at least one inset on each side panel.

5. The storage/transport container defined in claim 1 wherein the rods of the one set of rods further have at least one straight inner portion lying inward of the respective vertical plane and connected between two of the respective inner portions.

6. The storage/transport container defined in claim 1 wherein each horizontal rod has in each side panel one such inner portion flanked by two such angled portions in turn flanked by two such outer portions.

7. The storage/transport container defined in claim 1 wherein the inner ends are directly connected together to form a V-section inset.

8. The storage/transport container defined in claim 7 wherein a respective rod of the other set is fixed to the rods of the one set where the inner ends are connected together.

9. The storage/transport container defined in claim 1 wherein the rods of the one set of each side are each formed with more than two such outer portions and more than two such angled portions forming at least two groove-like reinforcing insets in the respective side panel.

10. The storage/transport container defined in claim 1 wherein the liner vessel has flat and smooth side walls.

11. The storage/transport container defined in claim 1 wherein the liner vessel has side walls formed with grooves complementary to and interfitting with the insets.

12. The storage/transport container defined in claim 1 wherein the pallet is made principally of wood and is provided with clips securing itself to a lowermost one of the horizontal rods of each side panel.

13. The storage/transport container defined in claim 1 wherein the pallet is made of sheet steel and includes a generally rectangular upper plate defining the edge, an annular base frame shaped to fit within an upper end of the wall of another such container, and spacer blocks fixed between the frame and the plate and projecting outward at the corners past the frame to the edge, whereby when one such container is stacked atop another such container the blocks rest atop and the frame fits within the topmost horizontal rod of the wall.

14. The storage/transport container defined in claim 13 wherein the frame is tubular.

15. The storage/transport container defined in claim 13 wherein the frame is made of profiled steel elements.

16. The storage/transport container defined in claim 15 wherein the frame is made of flat steel strips.

17. The storage/transport container defined in claim 13 wherein the frame is dimensioned to lie within the insets and out of contact with the angled portions when the containers are fitted together.

18. The storage/transport container defined in claim 1 wherein when one such container is stacked atop another such container the frame of the overlying container projects down into the underlying container by a distance equal to a vertical thickness of the frame.

19. The storage/transport container defined in claim 1 wherein the rods are all of round section, are welded together, and include an uppermost horizontal rod that is stronger than the other horizontal rods.

20. The storage/transport container defined in claim 1 wherein the horizontal rods are all annular and continuous.

* * * * *